US007459859B2

(12) United States Patent
Tseng et al.

(10) Patent No.: US 7,459,859 B2
(45) Date of Patent: Dec. 2, 2008

(54) ORGANIC LIGHT EMITTING DISPLAY HAVING ORGANIC LIGHT EMITTING DIODE CIRCUIT WITH VOLTAGE COMPENSATION AND TECHNIQUE THEREOF

(75) Inventors: Ming-Chun Tseng, Tainan (TW); Hong-Ru Guo, Tainan (TW); Chien-Hsiang Huang, Sinying (TW)

(73) Assignee: Chi Mei Optoelectronics Corp., Tainan County (TW)

( * ) Notice: Subject to any disclaimer, the term of this patent is extended or adjusted under 35 U.S.C. 154(b) by 243 days.

(21) Appl. No.: 11/567,989

(22) Filed: Dec. 7, 2006

(65) Prior Publication Data

US 2007/0159432 A1 Jul. 12, 2007

(30) Foreign Application Priority Data

Dec. 8, 2005 (TW) ..... 94143429 A

(51) Int. Cl.
*G09G 3/10* (2006.01)

(52) U.S. Cl. ..... 315/169.3; 345/76; 345/77

(58) Field of Classification Search ... 315/169.1–169.3; 345/76, 77, 80, 82, 204, 211, 214
See application file for complete search history.

(56) References Cited

U.S. PATENT DOCUMENTS 7,046,240 B2 * 5/2006 Kimura ..... 345/212
7,245,278 B2 * 7/2007 Hu et al. ..... 345/82
7,420,530 B2 * 9/2008 Asano et al. ..... 345/78

* cited by examiner

*Primary Examiner*—Douglas W. Owens
*Assistant Examiner*—Jimmy T Vu

(57) ABSTRACT

An organic light emitting diode circuit of an organic light emitting display with voltage compensation technique includes a first capacitor, a first TFT, a second TFT, a third TFT, a reset circuit and an OLED. The first TFT has a first terminal for receiving a first voltage, and a second terminal coupled to its gate and a first end of the first capacitor. The second TFT has a first terminal for receiving a second reference voltage and a gate coupled to the gate of the first TFT. The third TFT is coupled to the first capacitor and receives a pixel voltage and scan signal. The reset circuit sets the first end of the first capacitor to have a first voltage level. The OLED has an anode coupled to a second terminal of the second TFT and a cathode for receiving a third reference voltage. The first voltage level is smaller than a voltage level of the first reference voltage.

24 Claims, 15 Drawing Sheets

ORGANIC LIGHT EMITTING DISPLAY HAVING ORGANIC LIGHT EMITTING DIODE CIRCUIT WITH VOLTAGE COMPENSATION AND TECHNIQUE THEREOF

This application claims the benefit of Taiwan application Ser. No. 94143429, filed Dec. 8, 2005, the subject matter of which is incorporated herein by reference in its entirety.

BACKGROUND OF THE INVENTION

1. Field of the Invention

The invention relates in general to an organic light emitting display, and more particularly to an organic light emitting diode circuit for such a display.

2. Description of the Related Art

An organic light emitting diode circuit used in organic light emitting display normally stores signals for controlling the luminance of an organic light emitting diode (OLED) via thin film transistors (TFTs) and capacitors. However, the above TFTs, after prolonged use, will exhibit a threshold voltage (Vth) shift. This shift amount is related to the operation time of the TFTs and the current flowing therethrough.

In a display process, owing that the TFT for driving an OLED for each diode has a different current when turned on, and the driving TFTs will have different shift amounts of threshold voltage. As a result, the luminance of each diode will not have the same correspondence relation as the received pixel data, which in turn results in an uneven frame display.

In order to solve the above issue, a voltage compensation technique is applied to a conventional organic light emitting diode. Referring to FIG. 1, a circuit diagram of a conventional organic light emitting diode is shown. An organic light emitting diode circuit 100 includes TFTs MP1~MP5, a storage capacitor Cst and an organic light emitting diode (OLED). The TFT MP3 is controlled by a scan signal Scan and the TFT MP1 is coupled between the TFT MP3 and the storage capacitor Cst. The TFT MP2 drives the OLED to illuminate according to a voltage of the storage capacitor Cst when the TFT MP4 is turned on. The TFT MP5 is controlled by a reset signal Rst and the TFT MP4 is controlled by an enable signal Enb.

The conventional organic light emitting diode circuit 100, as written pixel data Vdata, uses the TFT MP1 with the same device feature as the TFT MP2 to cancel the threshold voltage Vth2 of the TFT MP2. More specifically, when the scan signal Scan is enabled, the TFT MP3 is turned on and the pixel data Vdata charges the storage capacitor Cst via the TFTs MP3 and MP1. In the meanwhile, due to a voltage compensation feature of the TFT MP1, the voltage level at point X, that is, a gate voltage of the TFT MP2, is lower than a voltage level at point Y, that is, a threshold voltage Vth1 of the TFT MP1, and thus the voltage difference between the source and gate of the TFT MP2 is increased by Vth1. The threshold voltage Vth1 is substantially the same as the threshold voltage Vth2, and the voltage difference between the source and gate of the TFT MP2 is just equal to difference between Vdd and the pixel voltage Vdata. Therefore, the current $I_{OLED}$ flowing by the OLED is precisely related to the pixel voltage Vdata.

In the above compensation technique, the compensation operation is performed during a data writing stage to eliminate errors generated from the threshold voltage Vth2. However, recent OLED panels tend to be developed in high resolution and large size. As a result, the time for writing data is greatly reduced. However, the TFT MP1 has small current as it is turned on, and thus it needs longer compensation time, which will result in an irregular operation of the TFT MP1 and disability of the compensation mechanism. However, with the circuit design of a conventional voltage compensation arrangement, it is essential that the nodes X and Y both have a stable voltage state during the "data writing" stage, otherwise, a charge sharing issue will be generated at the frame display stage. Accordingly, the conventional voltage compensation arrangement is apt to exhibit the drawback that the the node X does not reach a stable voltage state for canceling Vth2 due to inadequate time. In this situation, the TFT MP1 is still turned on. As a result, the charge sharing issue is generated and the display luminance can not reach the predicted luminance in correspondence with the pixel voltage Vdata.

SUMMARY OF THE INVENTION

The invention is directed to an organic light emitting display and diode with a voltage compensation arrangement which improves the speed of threshold voltage compensation.

According to the present invention, an organic light emitting diode of an organic light emitting display equipped with a voltage compensation arrangement The organic light emitting diode circuit comprises a first capacitor, a first TFT, a second TFT, a third TFT, a reset circuit and an OLED. The first TFT has a first terminal for receiving a first reference voltage, and a second terminal coupled to its gate and a first end of the first capacitor. The second TFT has a first terminal for receiving a second reference voltage and a gate coupled to the gate of the first TFT. The third TFT has a first terminal for receiving a pixel voltage, a second terminal coupled to a second end of the first capacitor and a gate for receiving a scan signal. The reset circuit is for setting the first end of the first capacitor to have a first voltage level. The OLED has an anode coupled to a second terminal of the second TFT and a cathode for receiving a third reference voltage. The first voltage level is smaller than a voltage level of the first reference voltage.

The invention will become apparent from the following detailed description of the preferred but non-limiting embodiments. The following description is made with reference to the accompanying drawings.

DETAILED DESCRIPTION OF THE INVENTION

The invention is directed to an organic light emitting display having a voltage compensation arrangement which improves the speed of threshold voltage compensation.

Embodiment One

Figure 2:
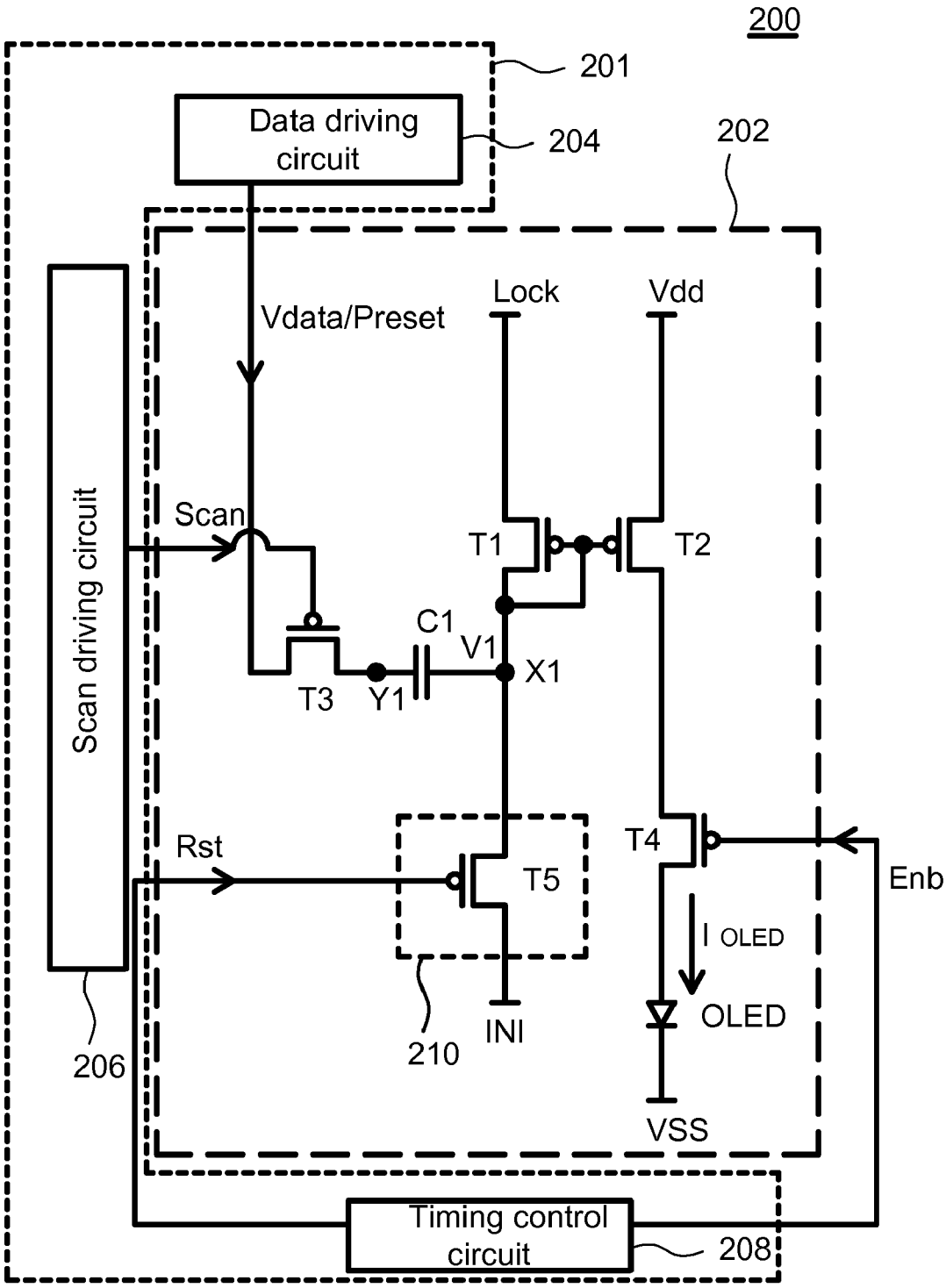
FIG. 2 is a schematic diagram of an organic light emitting display according to a first embodiment of the invention.

FIG. 2 is a schematic diagram of an organic light emitting display according to a first embodiment of the invention. An organic light emitting display 200 includes a driving unit 201 and an organic light emitting diode circuit 202. The driving unit 201 is for driving the organic light emitting diode circuit 202 and includes a data driving circuit 204, scan driving circuit 206 and timing control circuit 208. The data driving circuit 204 outputs a fifth voltage to the organic light emitting diode circuit 202 according to image data, wherein the fifth voltage is a pixel voltage Vdata or a low voltage Preset. The scan driving circuit 206 is for outputting a scan signal Scan. The timing control circuit 208 is configured to output a first control signal Enb to a fifth TFT T5 and a second control signal Rst to a reset circuit 210. The driving unit 201 also supplies a first voltage Lock, second voltage Vdd, third voltage Vss and fourth voltage INI. The organic light emitting diode circuit 202 includes a first capacitor C1, first TFT T1, second TFT T2, third TFT T3, fourth TFT T4, reset circuit 210 and an OLED. The TFTs T1~T4 are exemplified to be p-typed metal oxide semiconductor (PMOS) transistors as shown in FIG. 2.

The third TFT T3 has a first terminal for receiving the pixel voltage Vdata or the low voltage Preset, a second terminal coupled to a second end of the first capacitor C1 (i.e. the node Y1 denoted in FIG. 2) and a gate for receiving the scan signal Scan. The first TFT T1 has a first terminal for receiving the first voltage Lock, and a second terminal and a gate coupled together to a first end of the first capacitor C1 (i.e. the node X1 denoted in FIG. 2). The second TFT T2 has a first terminal for receiving the second voltage Vdd and a gate coupled to the gate of the first TFT T1. The fourth TFT T4 has a first terminal coupled to a second terminal of the second TFT T2, a second terminal coupled to an anode of the OLED and a gate for receiving the first control signal Enb.

A cathode of the OLED receives the third voltage Vss. The reset circuit 210, which is formed by the fifth TFT T5, is for setting the first end (i.e. the node X1) of the first capacitor C1 to have the first voltage level V1. The fifth TFT, such as a PMOS transistor, has a first terminal coupled to the first end X1 of the first capacitor C1, a second terminal for receiving the fourth voltage INI and a gate for receiving the second control signal Rst. It should be noted that the above first voltage level V1 is smaller than a voltage level of the first voltage Lock.

Figure 3:
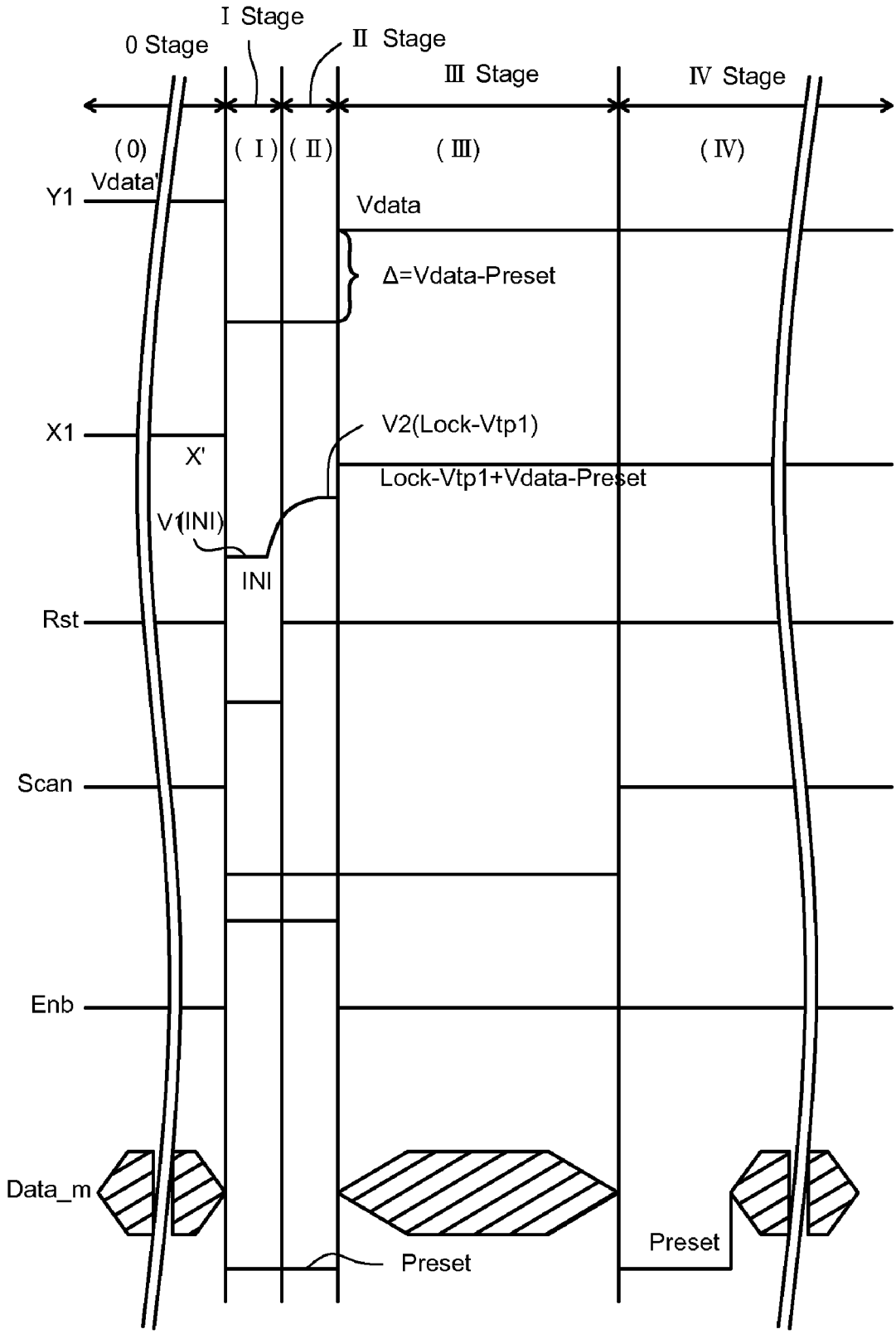
FIG. 3 is a timing diagram of the organic light emitting diode circuit according to the first embodiment of the invention.

Referring to FIG. 3, a timing diagram of the organic light emitting diode circuit according to the first embodiment of the invention is shown. In the 0-th stage 0 Stage (for displaying a previous frame), the scan signal Scan is set to have a voltage level such that the third TFT T3 is turned off, the second control signal Rst is set to have a voltage level such that the fifth TFT T5 is turned off, and the first control signal Enb is set to have a voltage level such that the fourth TFT T4 is turned on. Therefore, the voltage at the node Y1 is a pixel voltage Vdata' of the previous frame and the voltage at the node X1 is a voltage X' of the previous frame. The voltage X' of the node X1 is larger than the first voltage Lock. The first voltage Lock turns off the first TFT T1 in the meanwhile the voltage X' turns on the second TFT T2 to generate a current $I_{OLED}$. The current $I_{OLED}$ is equal to $Kp*(Vsg-Vtp2)^2$. The voltage Vsg is voltage difference between the gate and source of the second TFT T2, which is (Vdd−X'). The voltage Vtp2 is a threshold voltage of the third TFT T2. The current $I_{OLED}$ drives the OLED to illuminate through the fourth TFT T4.

Following this, in the first stage (I Stage), the voltage level of the second control signal is set such that the fifth TFT T5 is turned on, the voltage level of the scan signal Scan is set such that the third TFT T3 is turned on and the voltage level of the first control signal Enb is set such that the fourth TFT T4 is turned off. At this time, the data driving circuit 204 supplies a low voltage Preset. The low voltage Preset sets the voltage of the node Y1 to be the predetermined low voltage Preset, such as −1V~0V through the turned-on third TFT T3. The voltage of the node X1 is the fourth voltage INI due to turning on of the fifth TFT T5. At this stage, the first capacitor C1 is reset by the low voltage Preset and the fourth voltage INI.

In the second stage II Stage, the voltage level of the second control signal is set such that the fifth TFT T5 is turned off while the scan signal Scan and the first control signal Enb remain to have the same voltage level as in the previous stage. Therefore, the third TFT T3 remains turned on and the fourth TFT T4 remains turned off. At this time, the voltage of the node Y1 is still the low voltage Preset and the voltage of the node X1 rises up to a second voltage level V2 due to the effect of the turned-off fifth TFT T5 and the first TFT T1. The second voltage level V2 is the first voltage Lock subtracted by the threshold voltage Vtp1 of the first TFT T1.

In the third stage (III Stage) i.e. a data writing stage, the voltage level of the control signal Enb is changed such that the fourth TFT T4 is turned on, the second control signal Rst and scan signal Scan remain to have the same voltage level as in the second stage. At this time, the data driving circuit 204 outputs the pixel voltage Vdata. The voltage Vdata is provided through the third TFT T3 to set the voltage of the node Y1 as the pixel voltage Vdata. The voltage of the node X1 also rises up to (Lock−Vtp1+Vdata−Preset) due to an effect of the first capacitor C1, which causes the first TFT T1 to be turned off. At the time, the voltage difference between the gate and source of the second TFT T2 is the second voltage Vdd subtracted by the voltage level of the node X1, i.e. Vdd−(Lock−Vtp1+Vdata−Preset). A feature at this stage lies in due to the turned-on fourth TFT T4, a conductive current $I_{OLED}$ is generated corresponding to the voltage difference Vsg between the gate and source of the second TFT T2. The conductive current $I_{OLED}=Kp*(Vsg-Vtp2)^2$. The voltage difference Vsg is Vdd−(Lock−Vtp1 +Vdata−Preset). Therefore, the current $I_{OLED}=Kp*(Vdd-(Lock-Vtp1+Vdata-Preset)-Vtp2)^2$. Owing to Vtp1 being approximately equal to Vtp2, the current $I_{OLED}$ can be approximated to be Kp*(Vdd−

Lock−Vdata+Preset)$^2$. The OLED thus has a luminance corresponding to the current $I_{OLED}$.

In the fourth stage (IV Stage) for displaying the present frame, except that the voltage level of the scan signal Scan is changed such that the third TFT T3 is turned off and no pixel voltage is inputted to the third TFT T3, other components have the same operation and the nodes have the same as in the third stage III Stage.

Figure 1:
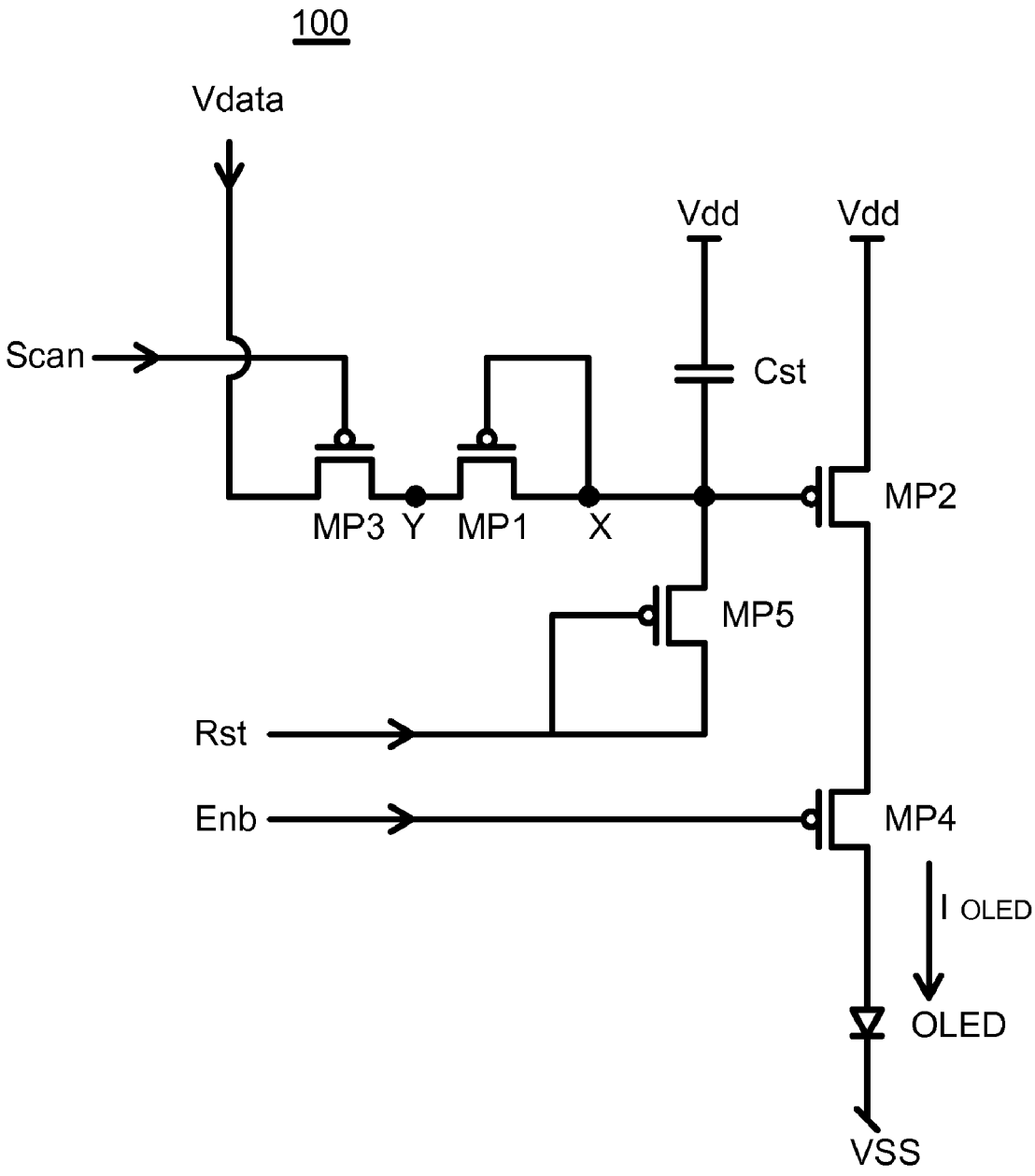
FIG. 1(PRIOR ART)
FIG. 1 is a circuit diagram of a conventional organic light emitting diode circuit.

As mentioned above, in the second stage (II Stage), the organic light emitting diode circuit 202 has completed a compensation operation for the threshold voltage Vtp2. This helps prevent the TFT in charge of a compensation operation for a threshold voltage, i.e. the TFT MP1 in FIG. 1 having a lower speed of compensation mechanism and thus solves the charge sharing issue in the data writing stage due to unstable voltage compensation, which results in an error data voltage and frame luminance, in the prior-art arrangement. On the other hand, by controlling the first voltage Lock, the operational speed of the compensation mechanism can be also increased to reduce compensation time. Owing to this fewer components are used in this embodiment and thus renders it more applicable to a small-size panel, such as in a hand-held equipment.

Figure 4:
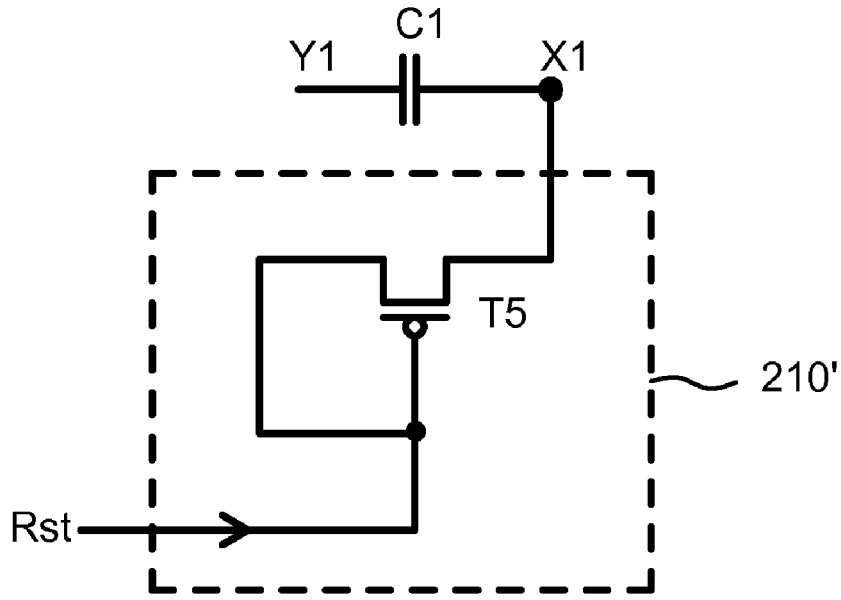
FIG. 4 is another example of the reset circuit depicted in FIG. 2.
Figure 5:
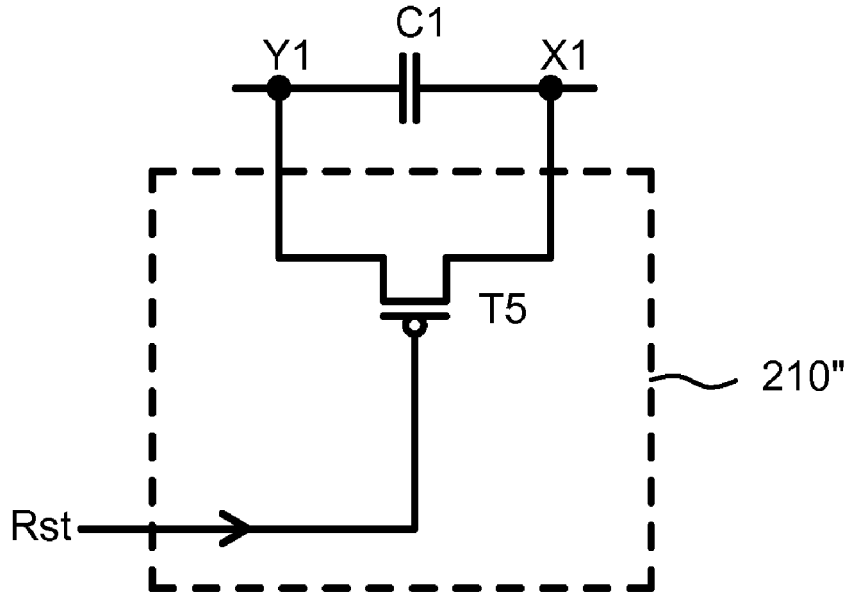
FIG. 5 is a further example of the reset circuit depicted in FIG. 2.

In addition, the above reset circuit 210 can be also implemented in a different circuit structure. As shown in FIG. 4, another reset circuit 210' consists of a fifth TFT T5 wherein the fifth TFT T5 has a first terminal coupled to the first end (i.e. the node X1) of the first capacitor C1, and a second terminal and a gate coupled together for receiving the second control signal Rst. Alternatively, as shown in FIG. 5, another reset circuit 210" also consists of the fifth TFT T5, but is such that it has a first terminal coupled to the first end (i.e. the node X1) of the first capacitor C1, a second terminal coupled to the other end of the first capacitor C1 and a gate for receiving the second control signal Rst.

Figure 6:
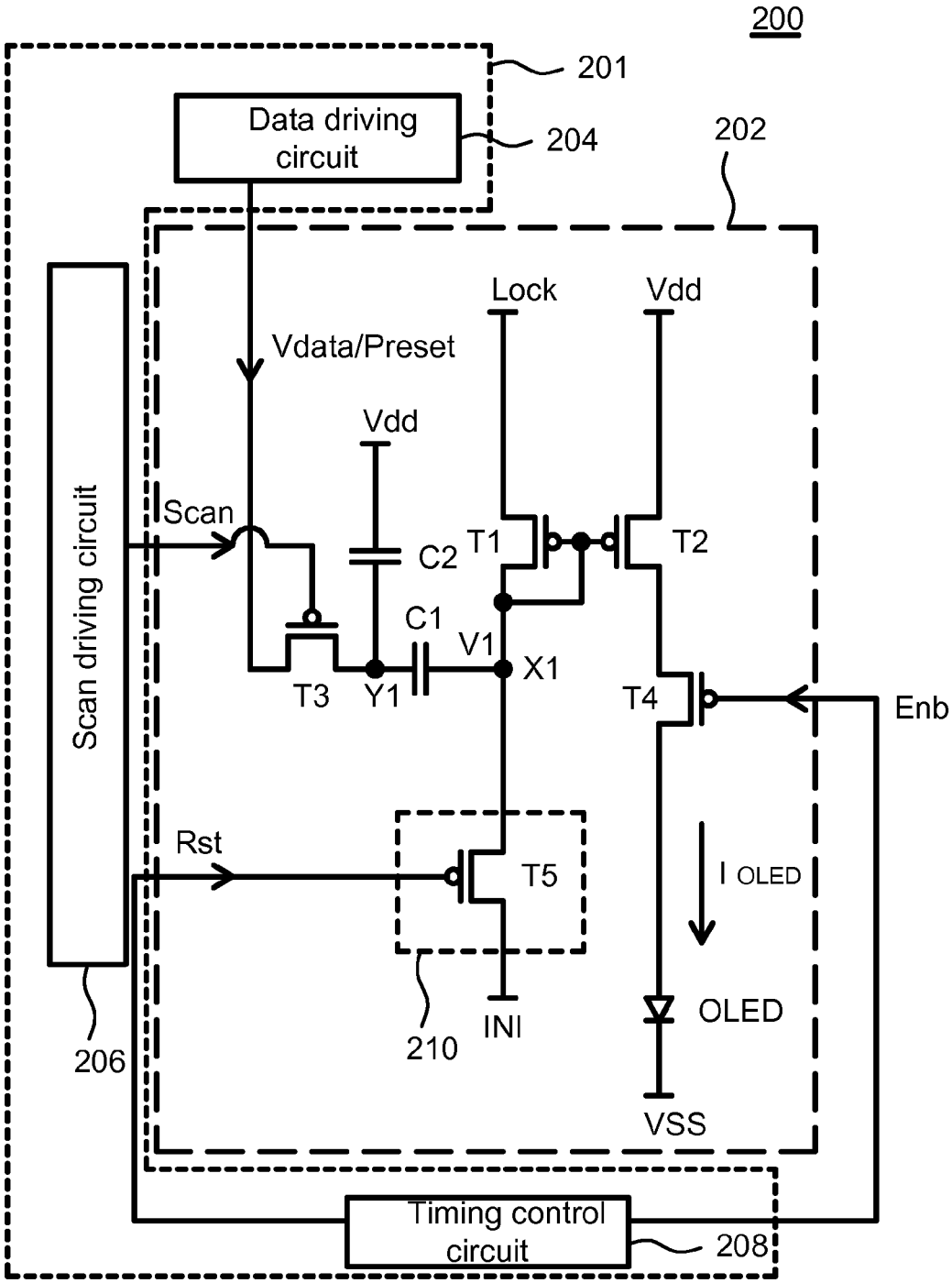
FIG. 6 is an internal circuit diagram of the organic light emitting diode circuit with a second storage capacitor according to the first embodiment of the invention.

The organic light emitting diode circuit 202 can also be coupled to a second capacitor C2. As shown in FIG. 6, in the organic light emitting diode circuit 202, the second capacitor C2 has a first end coupled to the node Y1 and a second end for receiving the second voltage Vdd. The second capacitor C2 helps maintain a stable voltage difference between the nodes X1 and Y1.

Figure 7:
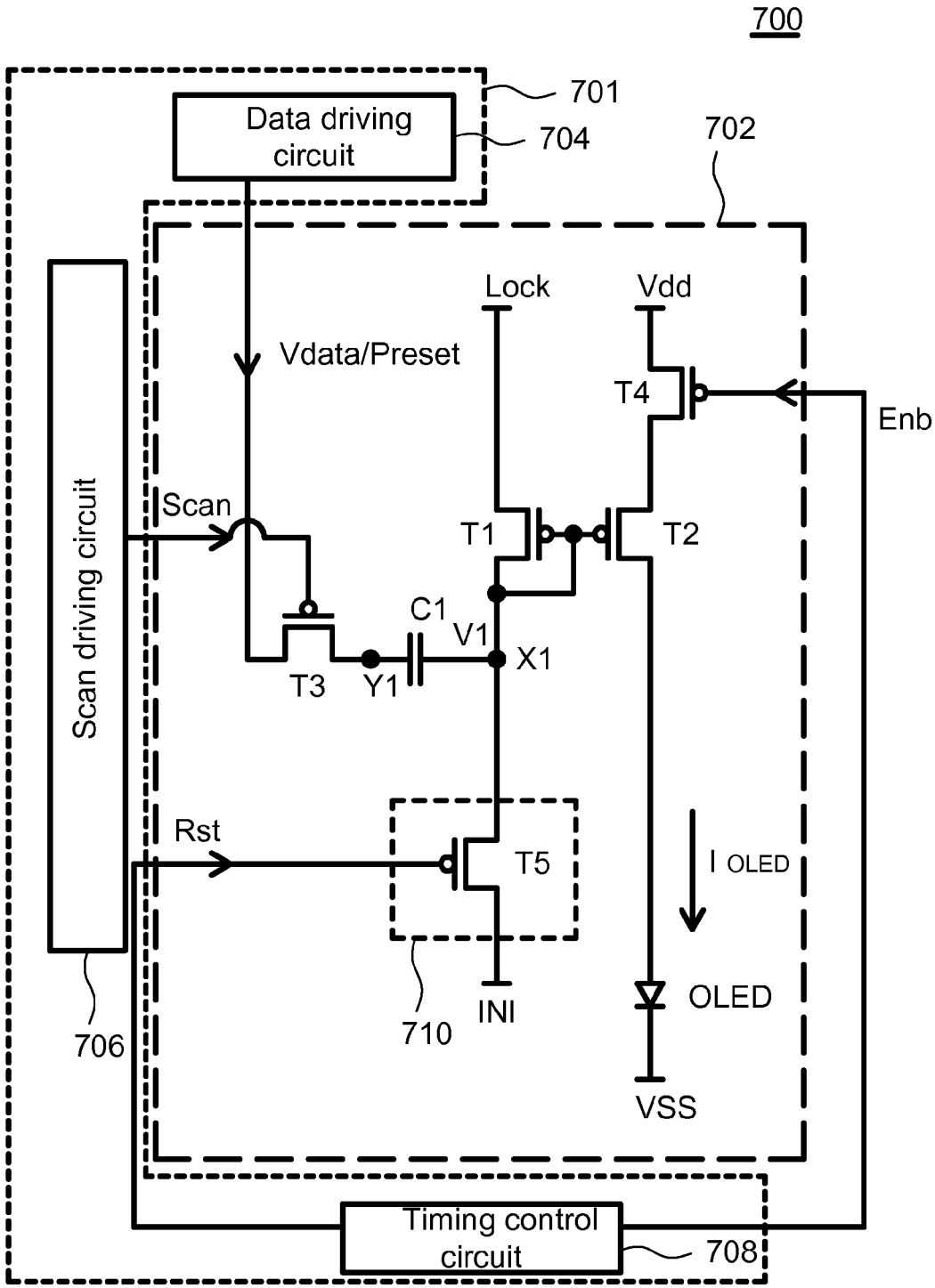
FIG. 7 is another example of the fifth TFT depicted in FIG. 2.

Moreover, the above fourth TFT T4 is for controlling the current $I_{OLED}$ to flow toward the OLED. Except for the disposition position as shown in FIG. 2, the fourth TFT T4 can be also disposed at a position as shown in FIG. 7. FIG. 7 is a schematic diagram of the second example of the organic light emitting display in the embodiment. In the organic light emitting diode circuit 702, the fourth TFT T4 can also be disposed between the second voltage Vdd and the second TFT T2. That is, the fourth TFT T4 has a first terminal for receiving the second voltage Vdd, a second terminal coupled to the first terminal (a source) of the second TFT T2 and a gate for receiving the first control signal Enb.

Figure 8:
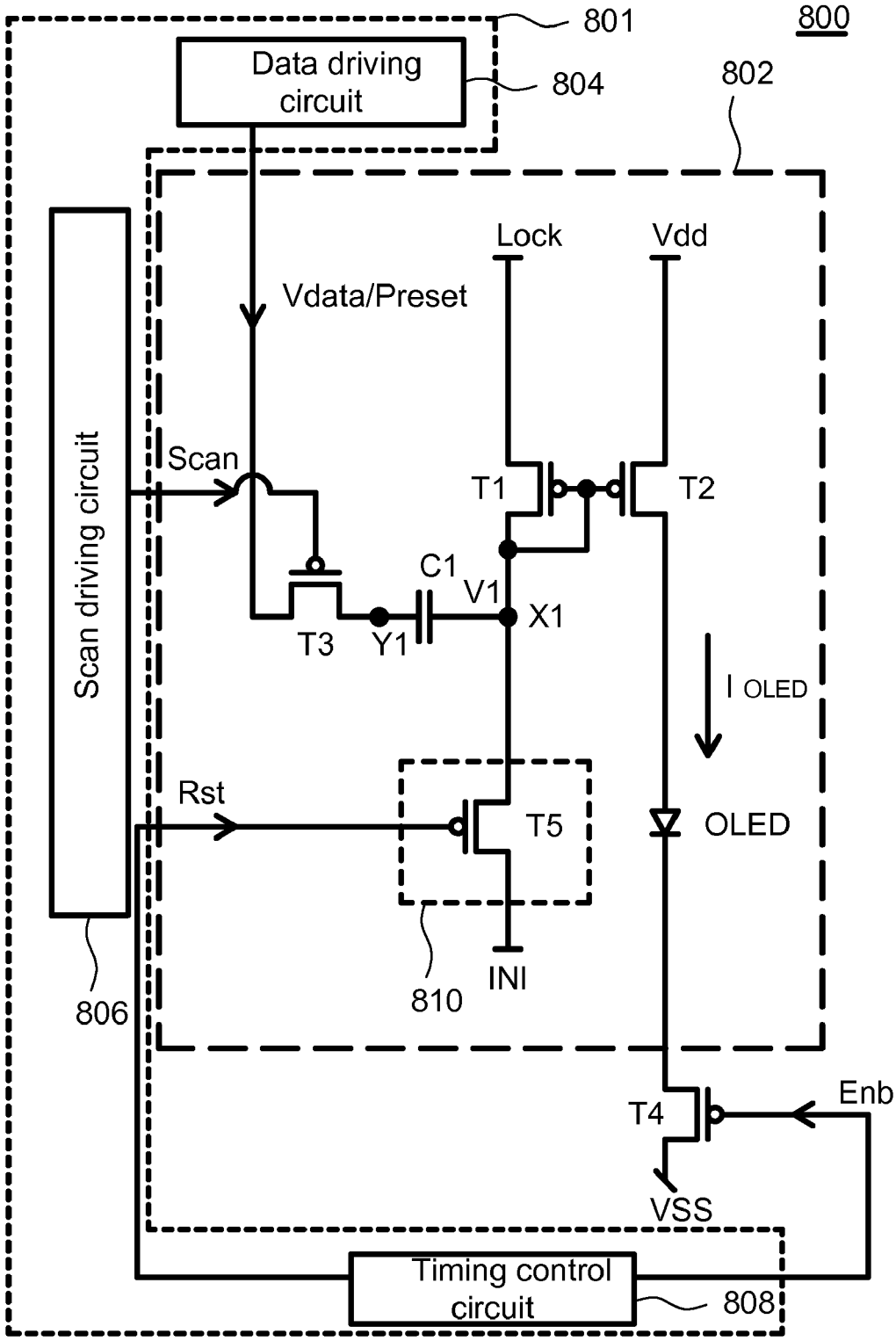
FIG. 8 is a further example of the fifth TFT depicted in FIG. 2.

Alternatively the fourth TFT T4 can also be coupled outside the organic light emitting diode circuit for controlling the current $I_{OLED}$ to flow toward the OLED. As shown in FIG. 8, which is a schematic diagram of the third example of the organic light emitting display in the embodiment, the fourth TFT T4 is coupled outside the organic light emitting diode circuit 802. That is, the fourth TFT T4 has a first terminal coupled to a cathode of the OLED, a second terminal coupled to the third voltage Vss and a gate for receiving the first control signal Enb.

Figure 9:
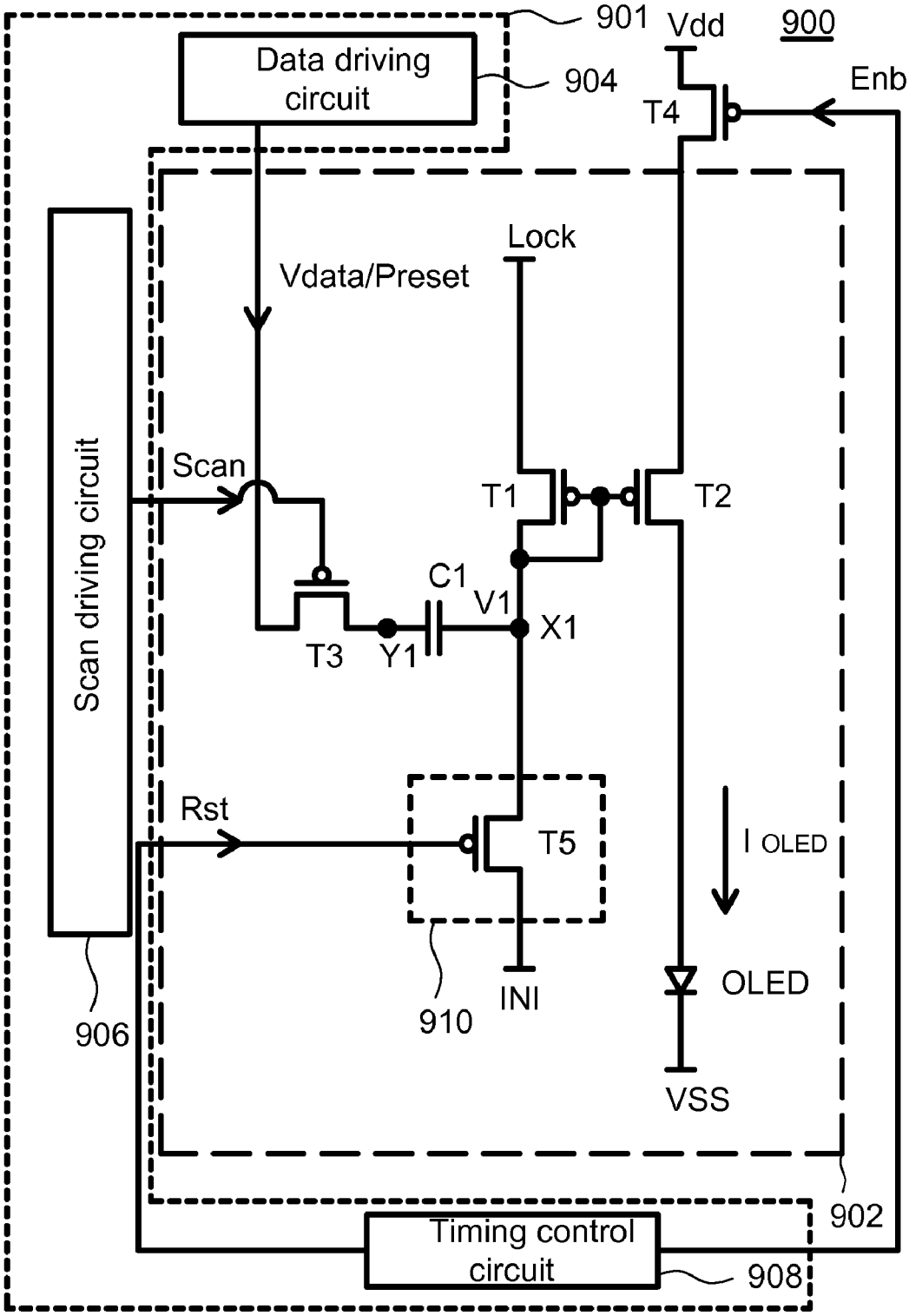
FIG. 9 is yet another example of the fifth TFT depicted in FIG. 2.

The fourth TFT T4 can also be coupled outside the organic light emitting diode circuit and between the second voltage Vdd and second TFT T2. As shown in FIG. 9, which is a schematic diagram of the fourth example of the organic light emitting display of the first embodiment, the fourth TFT T4 is coupled outside the organic light emitting diode circuit 902 and has a first terminal coupled to the first terminal of the second TFT T2, a second terminal coupled to the first voltage Vdd and a gate for receiving the first control signal Enb.

Embodiment Two

The difference this embodiment and the first embodiment lies in the structure of the reset circuit. In this embodiment, the reset circuit consists of two TFTs which are respectively coupled to two ends of the first capacitor for resetting the first capacitor and setting a potential of the node X1.

Figure 10:
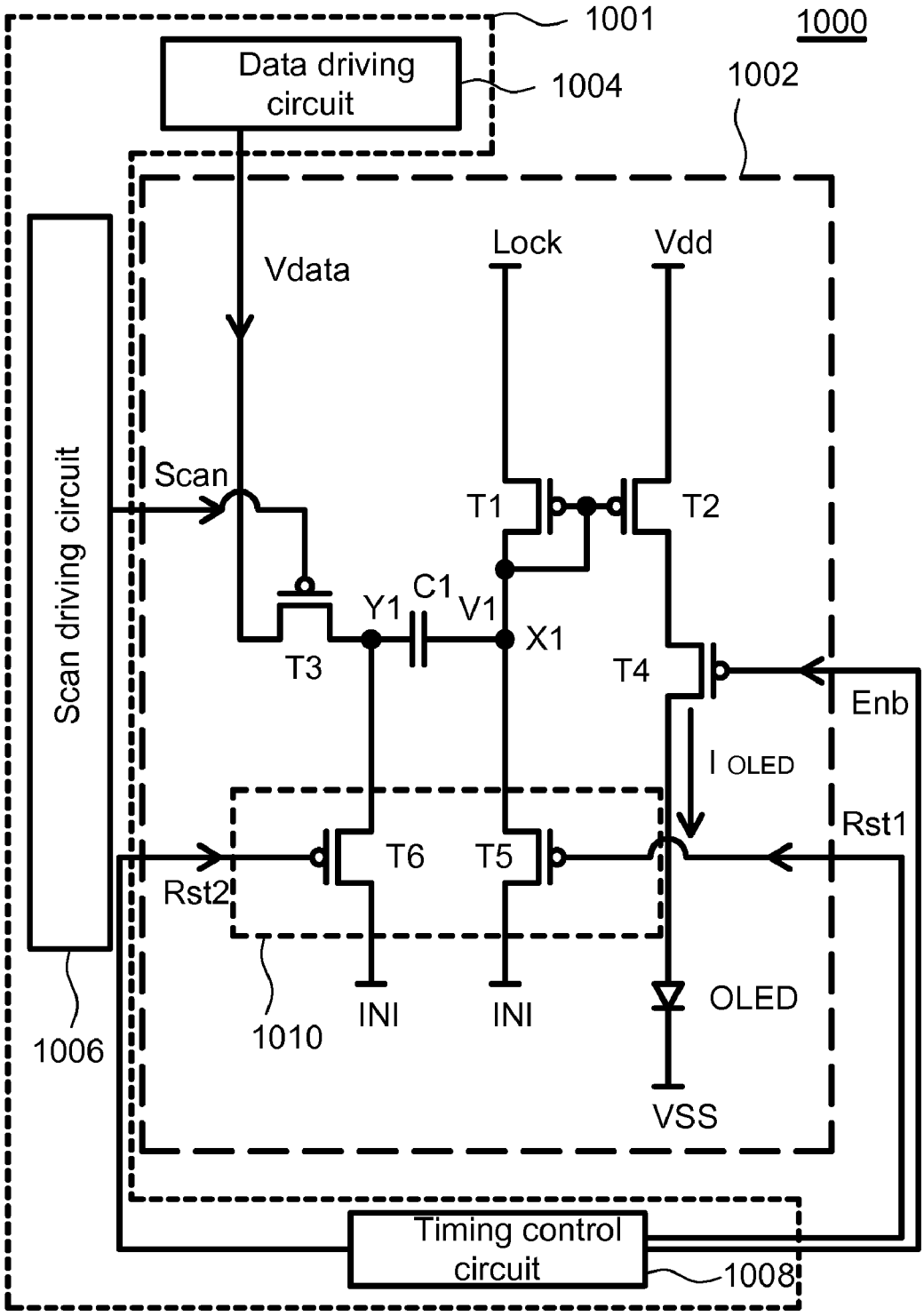
FIG. 10 is an internal circuit diagram of the organic light emitting diode circuit equipped with a voltage compensation arrnagement.

Referring to FIG. 10, a schematic diagram of an organic light emitting display according to a second embodiment of the invention is shown. An organic light emitting display 1000 includes a driving unit 1001 and an organic light emitting diode circuit 1002. The driving unit 1001 includes a data driving circuit 1004, scan driving circuit 1006 and timing controller 1008. The organic light emitting diode circuit 1002 also includes a first capacitor C1, a first TFT T1, a second TFT T2, a third TFT T3, a fourth TFT T4, a reset circuit 1010 and an OLED. The TFTs T1~T4 are exemplified as PMOS transistors as shown in FIG. 10. The organic light emitting display 1000 has the same structure as that in the first embodiment. Thus, details thereof are omitted for brevity.

It should be noted that the reset circuit 1010 consists of a fifth TFT T5 and sixth TFT T6. The fifth TFT T5 and a sixth TFT T6 are PMOS transistors by way of example only. The fifth TFT T5 has a first terminal coupled to a first end (i.e. the node X1) of the first capacitor C1, the second terminal for receiving the fourth voltage INI and a gate for receiving the second control signal Rst1. The sixth TFT T6 has a first terminal coupled to a second end (i.e. the node Y1) of the first capacitor C1, a second terminal for receiving the fourth voltage INI and a gate for receiving the third control signal Rst2. The first voltage level V1 is smaller than a voltage level of the first voltage Lock.

Figure 11:
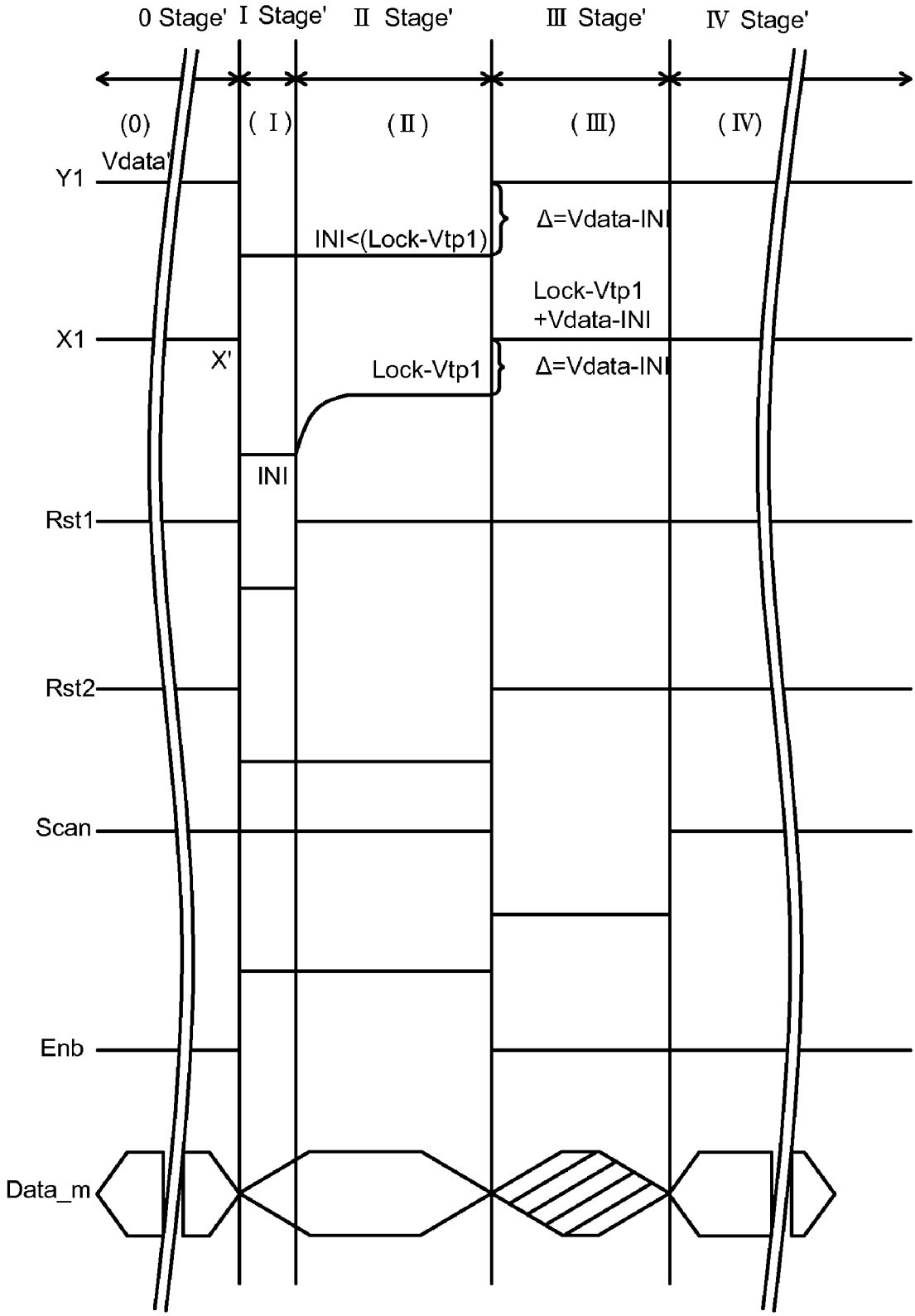
FIG. 11 is a timing diagram of the organic light emitting diode circuit according to a second embodiment of the invention.

Referring to FIG. 11, a timing diagram of the organic light emitting diode circuit according to the second embodiment of the invention is shown. In the 0-th stage (0 Stage'), the voltage level of the scan signal Scan is set such that the third TFT T3 is turned off, the voltage levels of the second control signal Rst1 and third control signal Rst2 are set such that the fifth TFT T5 and sixth TFT T6 are both turned off. Therefore, the voltage of the node Y1 is the pixel voltage Vdata' of the previous frame and the voltage of the node X1 is the voltage X' of the previous frame. The voltage X' of the node X1 is larger than the first voltage Lock and thus the first TFT T1 is turned off in the meanwhile the voltage X' also turns on the second TFT T2 to generate the current $I_{OLED}$. The current $I_{OLED}$ is Kp*(Vdd−Y'−Vtp2)$^2$. The voltage Vsg is voltage difference between the gate and source of the second TFT T2, which is Vdd−Y'. The voltage Vtp2 is a threshold voltage of the second TFT T2. The current $I_{OLED}$ drives the OLED to illuminate through the fourth TFT T4.

Following this, in the first stage (I Stage'), the voltage level of the scan signal Scan is changed such that the third TFT T3 is turned off, the voltage levels of the second control signal Rst1 and the third control signal Rst2 are changed such that the fifth TFT T5 and sixth TFT T6 are both turned on. At the time, the voltage of the nodes X1 and Y1 is the fourth voltage INI, such as −2V~−1V. At this stage, the first capacitor C1 is reset through the fourth voltage INI.

In the second stage (II Stage'), the voltage level of the second control signal is changed such that the fifth TFT T5 is turned off while the scan signal Scan, the first control signal Enb and the third control signal Rst2 remain at the same voltage level as in the first stage (I Stage'). Therefore, at this time, the voltage of the node Y1 is still INI and the voltage of the node X1 rises up to a second voltage level V2 due to an effect of the turned-off fifth TFT T5 and the first TFT T1. The second voltage level V2 is the first voltage Lock subtracted by the threshold voltage Vtp1 of the first TFT T1. In other words, this stage is for setting the second end Y1 of the first capacitor C1 to have the voltage level Lock−Vtp1.

In the third stage (III Stage) i.e. a data writing stage, the voltage level of the first control signal Enb is changed such that the fourth TFT T4 is turned on, the voltage level of the third control signal Rst2 is changed such that the sixth TFT T6 is turned off, the voltage level of the scan signal Scan is changed such that the third TFT T3 is turned on and the second control signal Rst1 remains at the original voltage level. At this time, the data driving circuit 1004 outputs the pixel voltage Vdata. The pixel voltage Vdata is provided through the turned-on third TFT T3 to set the voltage of the node Y1 as the pixel voltage Vdata. The voltage of the node X1 also rises up to (Lock−Vtp1+Vdata−INI) due to an effect of the first capacitor C1, which causes the first TFT T1 to be turned off. At this time, the voltage difference Vsg between the gate and source of the second TFT T2 is the second voltage Vdd subtracted by the voltage level of the node X1, i.e. Vdd−(Lock−Vtp1+Vdata−INI).

Vsg−Vtp=Vdd−(Lock−Vtp+Vdata−INI)−Vtp=Vdd−Lock−Vdata+INI. Therefore, the current $I_{OLED}$=Kp*(Vdd−(Lock−Vtp1+Vdata−INI)−Vtp2)$^2$. Owing to the fact that Vtp1 is approximately equal to Vtp2, the current $I_{OLED}$ can be approximated to be Kp*(Vdd−Lock−Vdata+INI)$^2$. The OLED therefore has a luminance corresponding to the current $I_{OLED}$.

In the fourth stage (IV Stage') i.e. the frame display stage, except that the voltage level of the scan signal Scan is changed such that the third TFT T3 is turned off and no pixel voltage is inputted to the third TFT T3, other components exhibit the same operation and the nodes have the same as in the third stage (III Stage').

As mentioned above, it can known that in the second stage (II Stage'), the organic light emitting diode circuit 1002 has completed a compensation operation for the threshold voltage Vtp2. This helps prevent the TFT in charge of a compensation operation for a threshold voltage, i.e. the TFT MP1 in FIG. 1 having a lower speed of compensation mechanism and thus solve the charge sharing issue in the data writing stage due to unstable voltage compensation, which results in an error data voltage and frame luminance, in the prior-art technique. On the other hand, by controlling the first voltage Lock, the operational speed of the compensation mechanism can be also increased to reduce compensation time. Owing to the fact that more components are used, this embodiment tends to be more applicable to large-size panels, such as in a display equipment.

Figure 12:
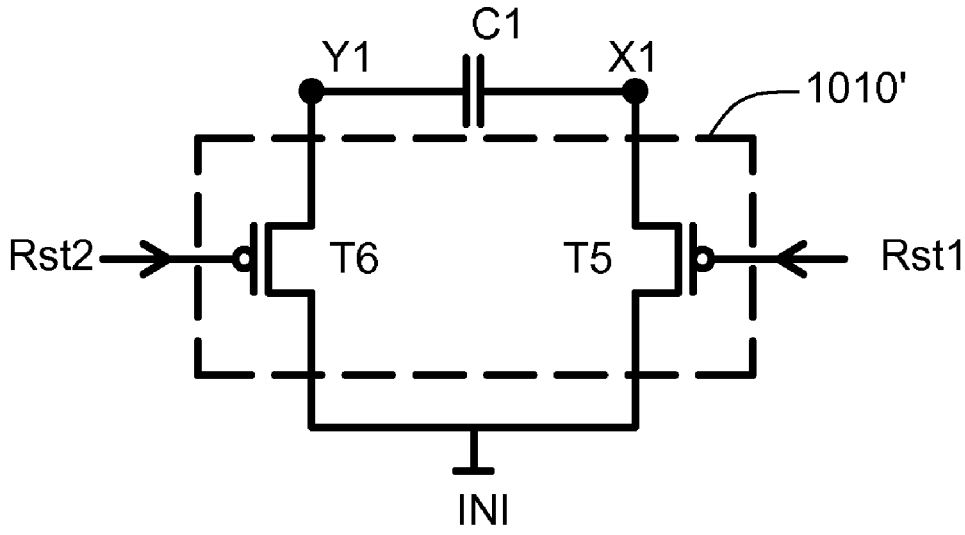
FIG. 12 is another example of the reset circuit depicted in FIG. 10.
Figure 13:
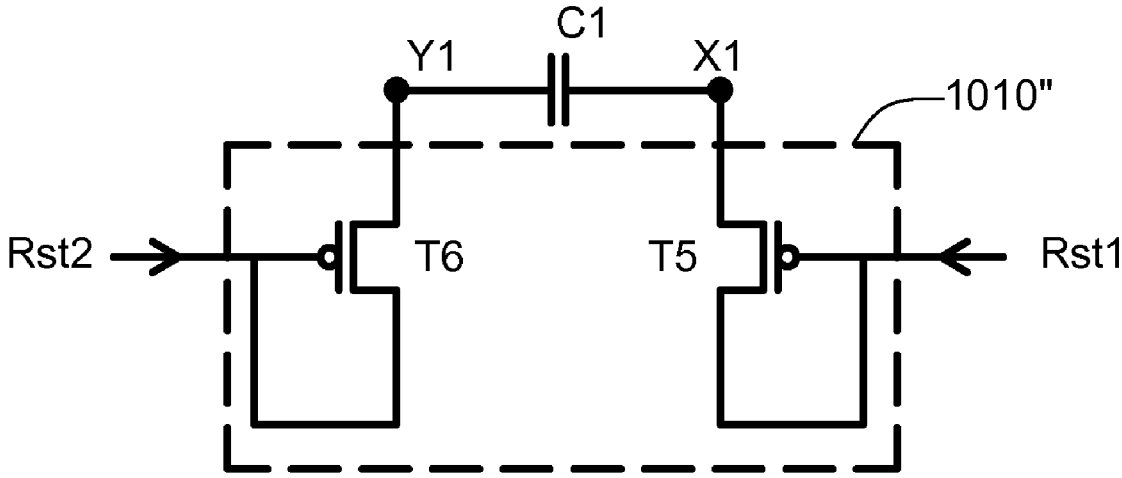
FIG. 13 is another example of the reset circuit depicted in FIG. 10.

Besides, the above reset circuit 1010 can be also implemented using different circuit structure. As shown in FIG. 12, another example of a reset circuit 1010' consists of the fifth TFT T5 and sixth TFT T6, wherein the fifth TFT T5 has a first terminal coupled to the first end (i.e. the node X1) of the first capacitor C1, and a second terminal for receiving the fourth voltage INI, and a gate for receiving the second control signal Rst1. The sixth TFT T6 has a gate for receiving the third control signal Rst2. Or as shown in FIG. 13, another reset circuit 1010" is also consisted of the fifth TFT T5 and sixth TFT T6, but the fifth TFT T5 has a first terminal coupled to the first end (i.e. the node X1) of the first capacitor C1, and a second terminal and a gate coupled together for receiving the second control signal Rst1. The sixth TFT T6 has a first terminal coupled to the second end (i.e. the node Y1) of the first capacitor C1, a second terminal coupled and a gate together for receiving the third control signal Rst2.

Figure 14:
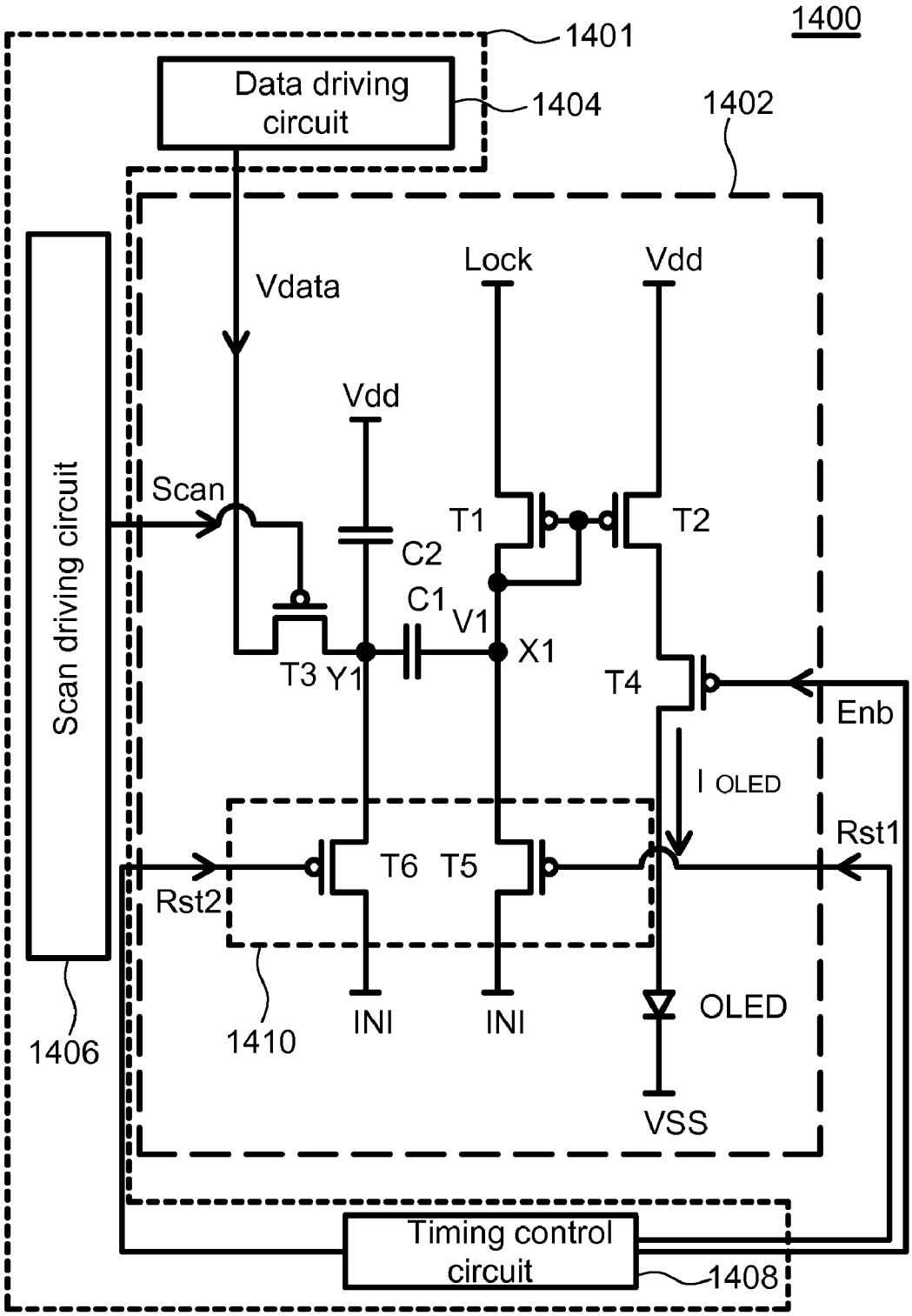
FIG. 14 is an internal circuit diagram of the organic light emitting diode circuit with a second storage capacitor according to the second embodiment of the invention.

The organic light emitting diode circuit 1002 can also be coupled to a second capacitor C2. As shown in FIG. 14, in the organic light emitting diode circuit 1402, the second capacitor C2 has a first end coupled to the node Y1 and a second end for receiving the second voltage Vdd. The second capacitor C2 helps maintain a stable voltage difference between the nodes X1 and Y1.

Figure 15:
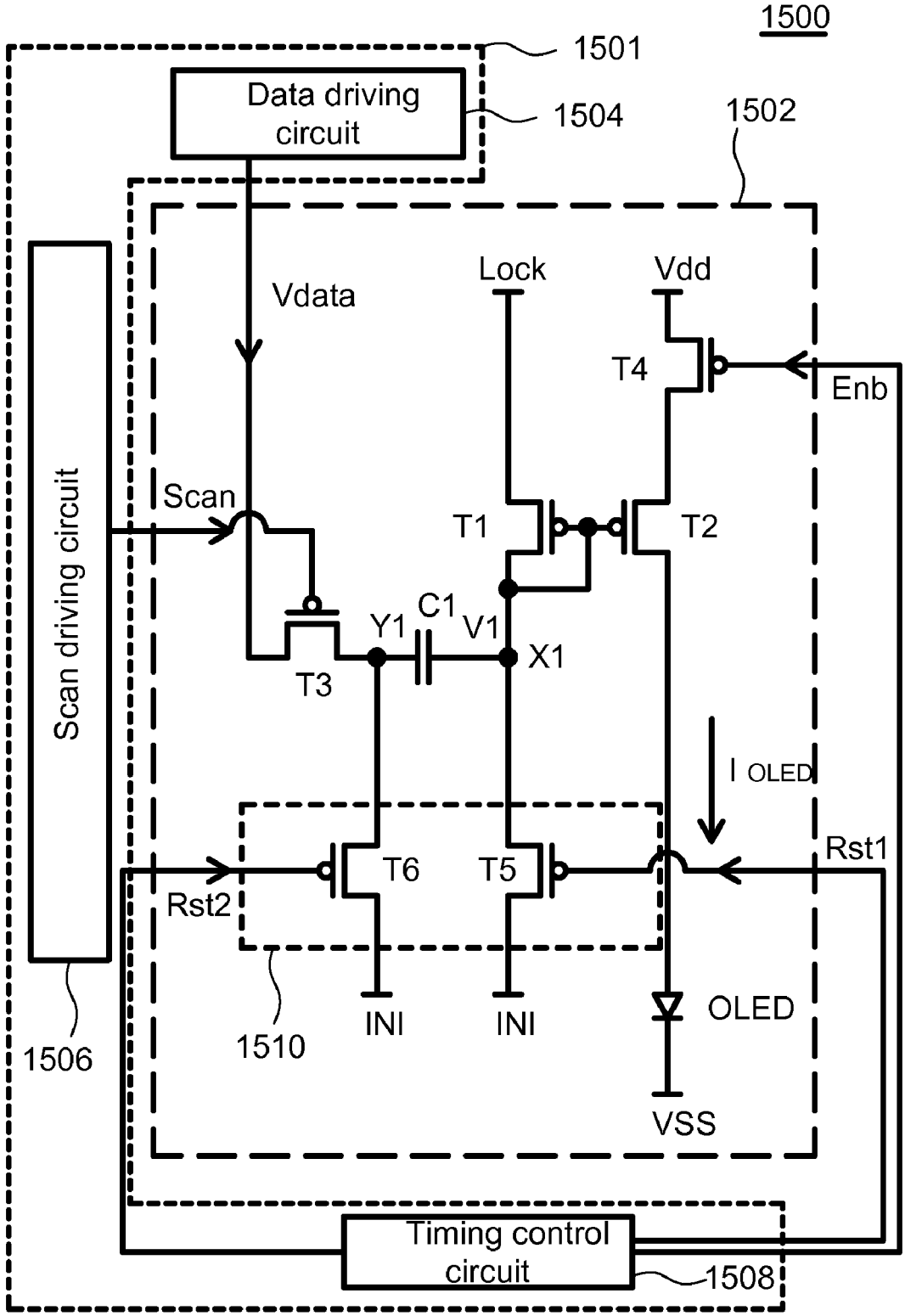
FIG. 15 is another example of the fifth TFT depicted in FIG. 10.

Moreover, the above fourth TFT T4 is for controlling the current $I_{OLED}$ to flow toward the OLED. Except for the disposition position shown in FIG. 10, the fourth TFT T4 can be also disposed at a position as shown in FIG. 15. FIG. 15 is a schematic diagram of the second example of the organic light emitting display in the embodiment. In the organic light emitting diode circuit 1502, the fourth TFT T4 has a first terminal for receiving the second voltage Vdd, a second terminal coupled to the first terminal of the second TFT T2 and a gate for receiving the first control signal Enb.

Figure 16:
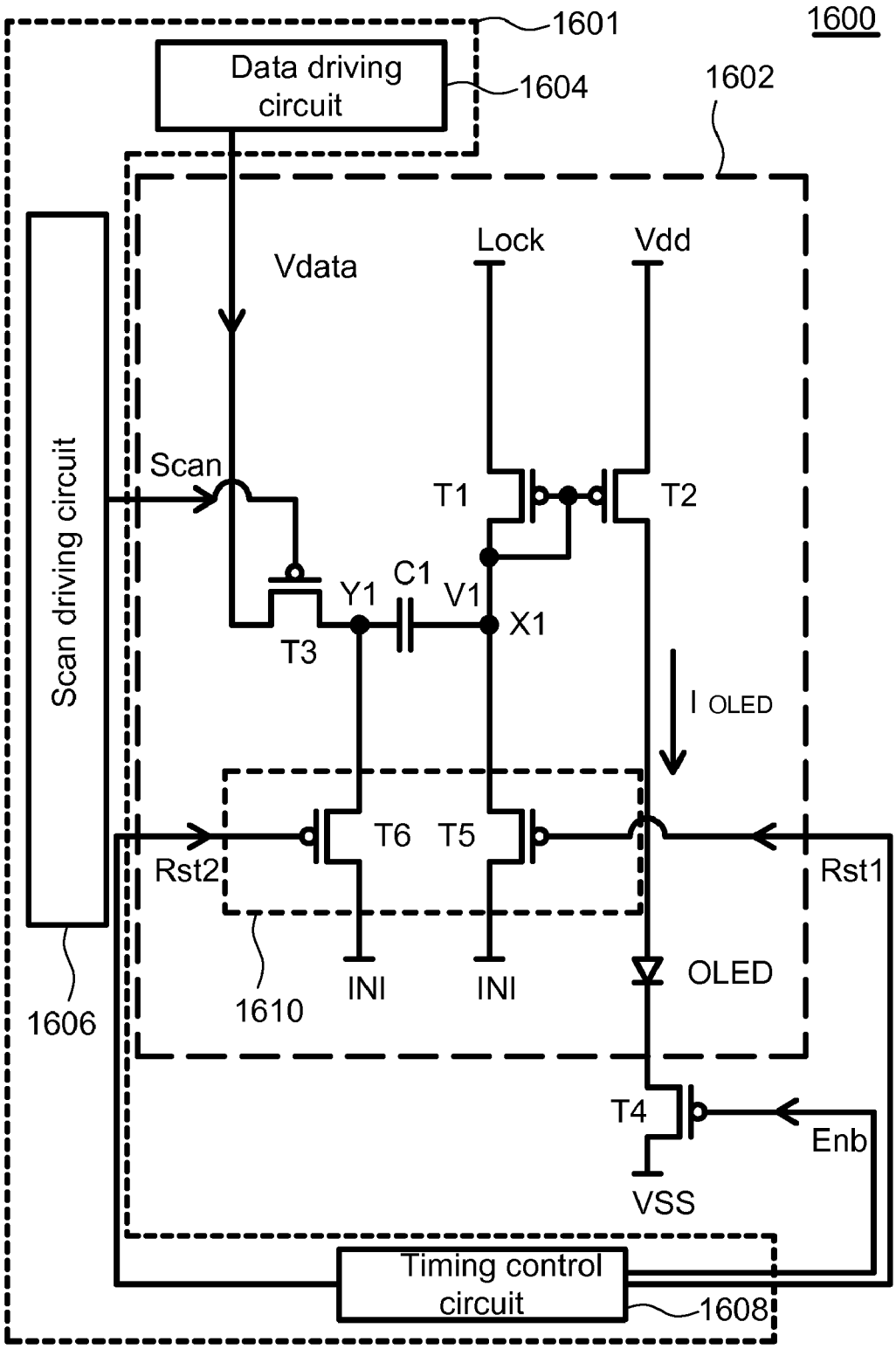
FIG. 16 is a further example of the fifth TFT depicted in FIG. 10.

Alternatively, the fourth TFT T4 can also be coupled outside the organic light emitting diode circuit for controlling the current $I_{OLED}$ to flow toward the OLED. As shown in FIG. 16, which is a schematic diagram of the third example of the organic light emitting display in the embodiment, the fourth TFT T4 is coupled outside the organic light emitting diode circuit 1602. The fourth TFT T4 has a first terminal coupled to a cathode of the OLED, a second terminal coupled to the third voltage Vss and a gate for receiving the first control signal Enb.

Figure 17:
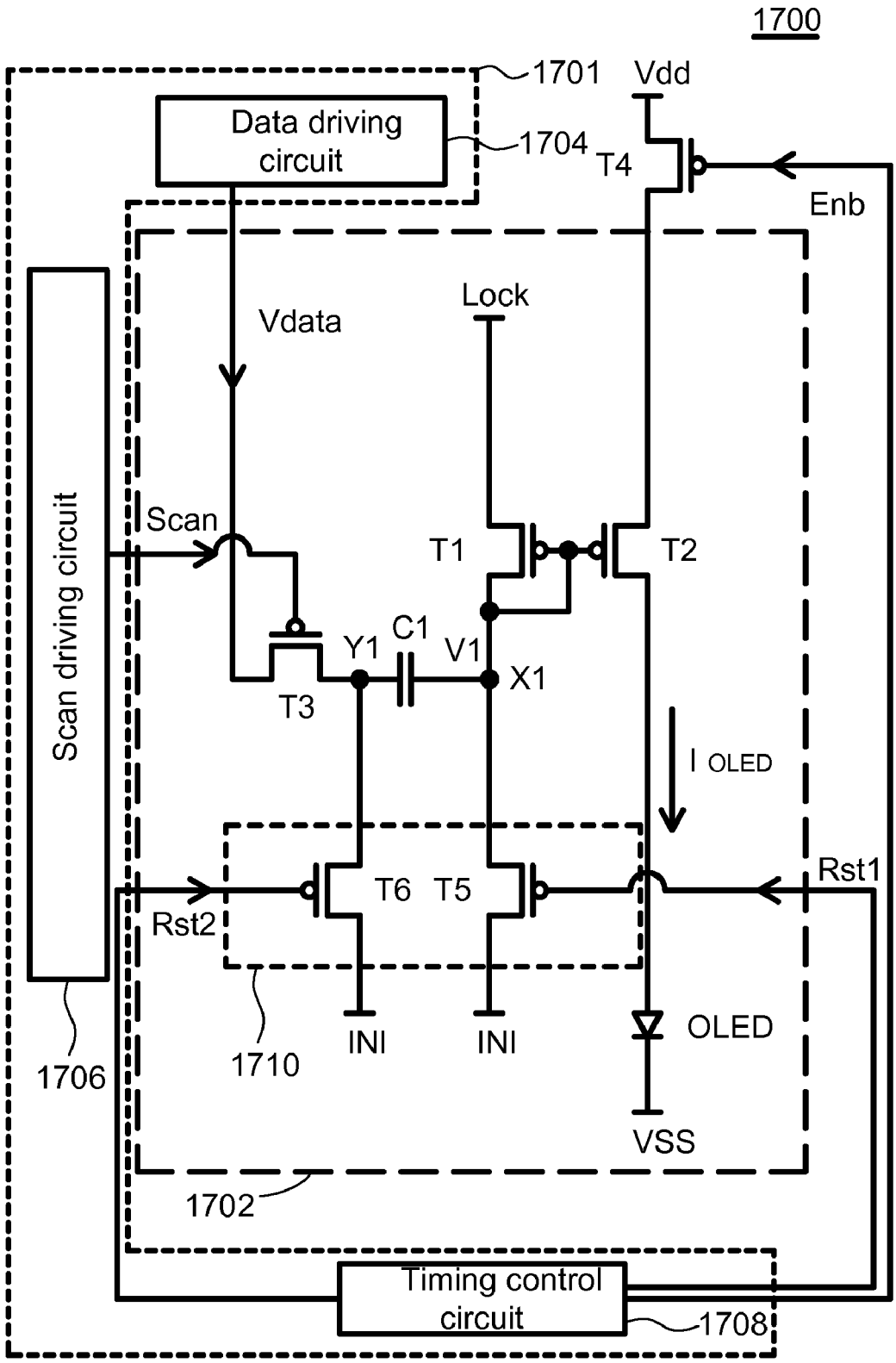
FIG. 17 is yet another example of the fifth TFT depicted in FIG. 10.

The fourth TFT T4 can also be coupled outside the organic light emitting diode circuit and between the second voltage Vdd and second TFT T2. As shown in FIG. 17, which is a schematic diagram of the fourth example of the organic light emitting display in the embodiment, the fourth TFT T4 is coupled outside the organic light emitting diode circuit 1702 and has a first terminal coupled to the first terminal of the second TFT T2, a second terminal coupled to the first voltage Vdd and a gate for receiving the first control signal Enb.

The organic light emitting display and the organic light emitting diode circuit with the voltage compensation technique disclosed in connection with the above embodiments of the invention can increase the speed of the compensation process and consequently eliminate the drawback of uneven frame display of an active matrix organic light emitting display (AMOLED) due to the present low-temperature polysilicone technique.

While the invention has been described by way of example and in terms of a different embodiments, it is to be understood that the invention is not limited thereto. On the contrary, the scope of the present invention is intended to cover various modifications and similar arrangements and procedures, and the scope of the appended claims therefore should be accorded the broadest interpretation so as to encompass all such modifications and similar arrangements and procedures.

What is claimed is:

1. A method for driving an organic light emitting diode circuit, the organic light emitting diode circuit comprising a first capacitor, a first thin film transistor (TFT), a second TFT and an organic light emitting diode (OLED), a first end of the first capacitor coupled to a gate of the second TFT, a first terminal of the first TFT receiving a first voltage, a second terminal of the first TFT coupled to a gate of the first TFT and the first end of the first capacitor, a first terminal of the second TFT receiving a second voltage, a second terminal of the second TFT outputting a pixel current to an anode of the OLED, a cathode of the OLED receiving a third voltage, the method comprising:

turning off the OLED;

supplying a fourth voltage to the first end of the first capacitor and a fifth voltage to a second end of the first capacitor in duration when the OLED is turned off such that voltage difference of the fourth voltage and the first voltage is large enough for turning on the first TFT; and removing the fourth voltage such that the first end of the first capacitor has a first voltage level due to an effect of the second TFT in duration when the organic TFT is turned off and the second end of the first capacitor remains at the fifth voltage;

supplying a pixel voltage to the second end of the first capacitor in duration when the OLED is turned off and the first end of the first capacitor has the first voltage level; and turning on the OLED to output the pixel current to the OLED via the third TFT according to a voltage level of the first end of the first capacitor.

2. The method according to claim 1, wherein the step of providing the fifth voltage is performed via a data driving circuit and a third TFT, a first terminal of the third TFT receives the fifth voltage outputted by the data driving circuit, a second terminal of the third TFT is coupled to the second end of the first capacitor, a gate of the third TFT is for receiving a scan signal and when the scan signal has a voltage level capable of turning on the third TFT, the third TFT supplies the fifth voltage to the second end of the first capacitor.

3. The method according to claim 1, wherein the step of turning off the OLED is implemented by a fourth TFT, a first terminal and a second terminal of the fourth TFT are coupled in series to a path of the pixel current, the first terminal is a source or drain, and the second terminal is a drain or source.

4. The method according to claim 1, wherein the voltage level of the fifth voltage is substantially the same as the voltage level of the fourth voltage.

5. An organic light emitting diode circuit, comprising:

a first capacitor;

a first TFT, having a first terminal for receiving a first voltage and a second terminal and a gate coupled together to a first end of the first capacitor;

a second TFT, having a first terminal for receiving a second voltage and a gate coupled to the gate of the first TFT;

a third TFT, having a first terminal for receiving a pixel voltage, a second terminal coupled to a second end of the first capacitor and a gate for receiving a scan signal;

a reset circuit, for setting the first end of the first capacitor to have a first voltage level; and an OLED, having an anode coupled to a second terminal of the second TFT and a cathode for receiving a third voltage;

wherein the first voltage level is smaller than a voltage level of the first voltage.

6. The organic light emitting diode circuit according to claim 5, further comprising:

a fourth TFT, having a first terminal coupled to the second terminal of the second TFT, a second terminal coupled to the anode of the OLED and a gate for receiving a first control signal.

7. The organic light emitting diode circuit according to claim 5, further comprising:

a fourth TFT, having a first terminal for receiving the second voltage, a second terminal coupled to the first terminal of the second TFT and a gate for receiving a first control signal.

8. The organic light emitting diode circuit according to claim 5, wherein the reset circuit is used for resetting the first capacitor, and the reset circuit comprises:

a fifth TFT, having a first terminal coupled to the first end of the first capacitor, a second terminal for receiving a fourth voltage and a gate for receiving a second control signal.

9. The organic light emitting diode circuit according to claim 5, wherein the reset circuit is used for resetting the first capacitor, and the reset circuit comprises:

a fifth TFT, having a first terminal coupled to the first end of the first capacitor, and a second terminal and a gate coupled to each other for receiving a second control signal.

10. The organic light emitting diode circuit according to claim 5, wherein the reset circuit is used for resetting the first capacitor, and the reset circuit comprises:

a fifth TFT, having a first terminal coupled to the first end of the first capacitor, a second terminal coupled to the second end of the first capacitor and a gate for receiving a second control signal.

11. The organic light emitting diode circuit according to claim 5, further comprising:

a second capacitor, having a first end coupled to the second end of the first capacitor and a second end for receiving the second voltage.

12. The organic light emitting diode circuit according to claim 5, wherein the reset circuit is used for resetting the first capacitor and the reset circuit comprises:

a fifth TFT, having a first terminal coupled to the first end of the first capacitor, a second terminal for receiving a fourth voltage and a gate for receiving a second control signal;

a sixth TFT, having a first terminal coupled to the second end of the first capacitor, a second terminal for receiving the fourth voltage and a gate for receiving a third control signal.

13. The organic light emitting diode circuit according to claim 5, wherein the reset circuit is used for resetting the first capacitor and the reset circuit comprises:

a fifth TFT, having a first terminal coupled to the first end of the first capacitor, a second terminal for receiving a fourth voltage and a gate for receiving a second control signal;

a sixth TFT, having a first terminal coupled to the second end of the first capacitor, a second terminal coupled to the second terminal of the fourth TFT and a gate for receiving a third control signal.

14. The organic light emitting diode circuit according to claim 5, wherein the reset circuit is used for resetting the first capacitor and the reset circuit comprises:

a fifth TFT, having a first terminal coupled to the first end of the first capacitor, and a second terminal and a gate coupled to each other for receiving a second control voltage;

a sixth TFT, having a first terminal coupled to the second end of the first capacitor, and a second terminal and a gate coupled to each other for receiving a third control signal.

15. An organic light emitting display, comprising:

at least an organic light emitting diode circuit, comprising:

a first capacitor;

a first TFT, having a first terminal for receiving a first voltage and a second terminal coupled to a gate of the first TFT and a first end of the first capacitor;

a second TFT, having a first terminal for receiving a second voltage and a gate coupled to a gate of the first TFT;

a third TFT, having a first terminal for receiving a pixel voltage, a second terminal coupled to a second end of the first capacitor and a gate for receiving a scan signal;

a reset circuit, for setting the first end of the first capacitor to have a first voltage level; and an OLED, having an anode coupled to a second terminal of the second TFT and a cathode for receiving a third voltage; and a driving unit, for driving the organic light emitting diode circuit, the driving unit comprising:

a data driving circuit, for outputting the pixel voltage;

a scan driving circuit, for outputting the scan signal; and a timing control circuit, for controlling the reset circuit to set the first end of the first capacitor to have the first voltage level;

wherein the first voltage level is smaller than a voltage level of the first voltage and the driving unit is for supplying the first voltage, the second voltage and the third voltage.

16. The organic light emitting display according to claim 15, wherein the organic light emitting diode circuit further comprises:

a fourth TFT, having a first terminal coupled to the second terminal of the second TFT, a second terminal coupled to the anode of the OLED and a gate for receiving a first control signal outputted by the timing control circuit.

17. The organic light emitting display according to claim 15, wherein the organic light emitting diode circuit further comprises:

a fourth TFT, having a first terminal for receiving the second voltage, a second terminal coupled to the first terminal of the second TFT and a gate for receiving a first control signal outputted by the timing control circuit.

18. The organic light emitting display according to claim 15, wherein the reset circuit is used for resetting the first capacitor, and the reset circuit comprises:

a fifth TFT, having a first terminal coupled to the first end of the first capacitor, a second terminal for receiving a fourth voltage provided by the driving unit and a gate for receiving a second control signal outputted by the timing control circuit.

19. The organic light emitting display according to claim 15, wherein the reset circuit is used for resetting the first capacitor, and the reset circuit comprises:

a fifth TFT, having a first terminal coupled to the first end of the first capacitor, and a second terminal and a gate coupled to each other for receiving a second control signal outputted by the timing control circuit.

20. The organic light emitting display according to claim 15, wherein the reset circuit is used for resetting the first capacitor, and the reset circuit comprises:

a fifth TFT, having a first terminal coupled to the first end of the first capacitor, a second terminal coupled to the second end of the first capacitor and a gate for receiving a second control signal outputted by the timing control circuit.

21. The organic light emitting display according to claim 15, further comprising:

a second capacitor, having a first end coupled to the second end of the first capacitor and a second end for receiving the second voltage.

22. The organic light emitting display according to claim 15, wherein the reset circuit is used for resetting the first capacitor and the reset circuit comprises:

a fifth TFT, having a first terminal coupled to the first end of the first capacitor, a second terminal for receiving a fourth voltage provided by the driving unit and a gate for receiving a second control signal outputted by the timing control circuit; and a sixth TFT, having a first terminal coupled to the second end of the first capacitor, a second terminal for receiving the fourth voltage and a gate for receiving a third control signal outputted by the timing control circuit.

23. The organic light emitting display according to claim 15, wherein the reset circuit is used for resetting the first capacitor and the reset circuit comprises:

a fifth TFT, having a first terminal coupled to the first end of the first capacitor, a second terminal for receiving a fourth voltage provided by the driving unit and a gate for receiving a second control signal outputted by the timing control circuit; and a sixth TFT, having a first terminal coupled to the second end of the first capacitor, a second terminal coupled to the second terminal of the fourth TFT and a gate for receiving a third control signal outputted by the timing control circuit.

24. The organic light emitting display according to claim 15, wherein the reset circuit is used for resetting the first capacitor and the reset circuit comprises:

a fifth TFT, having a first terminal coupled to the first end of the first capacitor, and a second terminal and a gate coupled to each other for receiving a second control voltage outputted by the timing control circuit; and a sixth TFT, having a first terminal coupled to the second end of the first capacitor, and a second terminal and a gate coupled to each other for receiving a third control signal outputted by the timing control circuit.

* * * * *